United States Patent [19]

Gerwin

[11] 4,115,050

[45] Sep. 19, 1978

[54] BURNER CONSTRUCTION AND METHOD FOR BURNING LIQUID AND/OR GASEOUS FUEL

[75] Inventor: Reinhard Gerwin, Stuttgart, Germany

[73] Assignee: J. Eberspacher, Germany

[21] Appl. No.: 722,576

[22] Filed: Sep. 13, 1976

[30] Foreign Application Priority Data

Oct. 9, 1975 [DE] Fed. Rep. of Germany ..... 2545234

[51] Int. Cl.[2] ..... F23D 15/02; F23Q 3/00

[52] U.S. Cl. ..... 431/352; 431/10; 431/265

[58] Field of Search ..... 431/10, 9, 8, 158, 265, 431/351, 352

[56] References Cited

U.S. PATENT DOCUMENTS

| | | | |
|---|---|---|---|
| 2,694,444 | 11/1954 | Oldenkamp | 431/265 X |
| 3,368,604 | 2/1968 | Mutchler | 431/352 X |
| 3,593,518 | 7/1971 | Gerrard | 431/352 X |
| 3,923,251 | 12/1975 | Flournoy | 431/351 X |

*Primary Examiner*—Edward G. Favors
*Attorney, Agent, or Firm*—McGlew and Tuttle

[57] ABSTRACT

A liquid and/or gaseous fuel is burned in a tubular combustion chamber which has at least one baffle wall therein with a central aperture therethrough, comprises directing the fuel into the combustion chamber in a stream adjacent the baffle so as to cause it to flow through the aperture of the baffle and directing combustion air into the combustion chamber around and substantially parallel to the fuel stream so as to cause a portion of it to be directed against the baffle plate and whirl around adjacent the aperture and a further portion to pass directly through the aperture and into the whirling stream so as to provide a turbulent air stream which intermixes with the fuel both downstream and upstream of the baffle, igniting the fuel and air as it intermixes, and directing a separate combustion air stream into the intermixed fuel and combustion air on the opposite downstream side of the baffle. In addition, the secondary combustion air supply may be admitted upstream of the baffle and the air streams may advantageously be directed radially and tangentially inwardly.

8 Claims, 10 Drawing Figures

BURNER CONSTRUCTION AND METHOD FOR BURNING LIQUID AND/OR GASEOUS FUEL

FIELD AND BACKGROUND OF THE INVENTION

This invention relates in general to the construction of fuel burners and to a method of burning both liquid and gaseous fuels and, in particular, to a new and useful fuel burner having a tubular combustion chamber with spaced apart inner and outer walls, with a baffle extending across the inner wall with an aperture therethrough and with means for directing the fuel centrally into the combustion chamber on one side of the baffle for flow through the aperture along with combustion air which is fed around the fuel supply and strikes against a portion of the baffle wall and whirls so as to intermix with the fuel which is further joined with additional combustion air supplied to the space between the walls and into the combustion chamber downstream of the baffle plate.

DESCRIPTION OF THE PRIOR ART

Devices are known for mixing fuel and air so as to improve the combustion of the fuel. Such devices include an air conducting cylinder which is surrounded by a cylindrical air sleeve and which includes a baffle plate which is provided with a central aperture mounted in the air conducting cylinder downstream of an oil atomizer nozzle. In addition, U.S. Pat. No. 3,224,682 discloses a mixing device in which the air feeding sleeve concentrically surrounds a plurality of cylindrical extensions of the frusto-conical air feed elements. In such a device, the arrangement of a plurality of flaring walls provided downstream of the oil atomizer nozzle has the same effect as a single baffle plate.

With the known mixing devices, a nearly soot-free and noiseless combustion, as well as high $CO_2$ values, are to be obtained by conducting one part of the combustion air as a secondary air stream through the intermediate space of the two concentric jackets and feeding it to the flame in a zone downstream of the baffle plate. At the same time, for better mixing with the fuel-air mixture of the root of the flame, the secondary air is deflected inwardly by inwardly bent edges of the concentric jackets between which the secondary air is supplied. Such an arrangement must prevent a breaking of the flame due to an excessive velocity of the combustion air downstream of the baffle plate.

These known mixing devices can be improved only to a minimum extent since only a small part of the secondary air fed to the flame of the burner participates in the combustion. This is because in the known mixing devices, the secondary air conducted through the concentric jackets and their inwardly bent rims to the root of the flame surrounds the flame as an air envelope and escapes, largely unused, with the exhaust gas and the burner must be operated with an unnecessarily high air volume in excess. This makes it possible to obtain a high $CO_2$ content in the exhaust gas and a high heating efficiency.

For this reason, such mixing devices of the prior art do not permit an operation with only a small excess air volume for obtaining secure, nearly soot-free, combustion. Further, the known mixing devices do not permit an operation of the burner with narrow, high-resistance boilers or in connection with narrow, longer, smokestacks, since, with such a construction, parasite pulsations are produced. Such pulsations occur more in cases where baffle plates are used which impart a rotary motion about the longitudinal axis to the combustion air stream in order to obtain a combustion with a minimum of soot.

In addition, the known mixing devices of the prior art are unsuitable for operating burners in motor vehicles where strong voltage variations in the power supply result in considerable variations in the speed of the combustion air blower. In uses with the smallest battery voltages which are ordinarily employed, a secure, nearly soot-free combustion can be obtained, and with the increase of the supply voltage, the air volume in excess becomes so large that neither a secure ignition and maintenance of the flame nor a satisfactory combustion are possible.

SUMMARY OF THE INVENTION

The present invention provides a burner constructed to ensure operation with very low soot emission which operates almost stoichiometric even when used with narrow, high-resistance boilers and long exhaust gas ducts. In accordance with the invention, the burner is provided in at least one plane downstream of the baffle plate in the combustion chamber with inwardly directed air outlet sockets for the admission of an additional air supply for combining with the air and gases which are directed into the combustion chamber on the opposite side of the baffle. With the inventive arrangement, the relatively small volume of secondary air which is directed on the downstream side of the baffle through the sockets which connect to a space between the inner and outer walls of the combustion chamber causes the penetration of the combustion air into the root of the burner flame so that it participates substantially completely in the combustion. Surprisingly, it has been found with the inventive arrangememnt that not only a secure, substantially soot-free combustion is obtained even with an almost stoichiometric air to fuel ratio but, at the same time, a pulsation-free operation of the burner with boilers which have a very small combustion chamber and a high resistance to the fuel gas flow with a connection with long exhaust gas ducts becomes possible.

Experience has also shown that for blowing the secondary air through the air outlet sockets, it is sufficient to use the excess pressure which is produced by the combustion air blower and is necessary for overcoming the back pressure caused by the baffle plate, that is, the excess pressure which is applied to the entire combustion air volume. The inventive arrangement also makes it possible to use baffle plates which impart a rotation about the longitudinal axis of the combustion air stream without producing parasite pulsations.

Advantageously, the length of the air outlet sockets is made equal to 0.5 to 2 times the inside diameter of the sockets so that a guidance and penetration of the secondary air into the root of the flame of the burner is obtained. In another embodiment of the mixing device, according to the invention, the air outlet sockets are designed as nozzles which make it possible to obtain the inventive effect also with air outlet sockets which are shorter than 0.5 times their inside diameter.

In accordance with another feature of the invention, the outlets of the air sockets extend in a plane which is inclined relative to the radial plane thereof and this is done so that the air outlet sockets are cut off obliquely. Thereby, an adjustment of the burner operated with the mixing device to the rate of fuel flow and dimensions of the combustion chamber is obtained in a particularly simple manner while the advantages of the invention are still maintained. The same effect is produced by providing that at least a part of the air outlet sockets is positioned at an angle relative to the radius of the inner jacket.

The air outlet sockets having their outlets extending in a plane forming an angle with the radial plane thereof may be mounted for rotation in the wall of the inner jacket. This makes it possible, in a particularly simple manner, to adjust the burner provided with the inventive mixing device to the outer operational conditions directly at the location where it is installed.

In another embodiment of the invention, the intermediate space between the outer and inner jackets is closed at its end which is located upstream of the baffle plate and the inner jacket is provided with openings.

These openings choke the combustion air flowing therethrough into the intermediate space and, in a simple manner, the mixing device is made more insensitive to operational conditions in which the combustion air stream produced by the burner blower is supplied in a direction which is not substantially axial relative to the mixing device. In addition, the openings provided in the inner jacket produce a turbulence of the combustion air flowing therethrough into the intermediate space so that the desirable preheating of the air is increased by heat transfer from the combustion chamber through the outer jacket.

In another advantageous embodiment of the mixing device in accordance with the invention, the combustion air flows through openings which are provided in the terminal wall connecting the outer and inner jackets and/or in the outer jacket from the intermediate space into the space of the combustion chamber of the boiler. This part of the combustion air causes a post-combustion of the incompletely burned fuel particles which are present in the combustion chamber in the vicinity of the mixing device so that, primarily in operation with narrow, high-resistance boilers, the outer surface of the mixing device is kept clean and free from residues from combustion. In addition, due to the post-combustion, the preheating of the combustion air flowing in the intermediate space between the outer and inner jackets is increased.

In another embodiment of the invention, a slider is provided in the intermediate space between the outer and inner walls or jackets of the combustion chamber. The slider is movable to cover a part or all of the air outlet sockets and/or the openings in the outer jacket. By means of this slider, a secure ignition of the burner is possible under particular operational conditions such as may occur with the operation of a burner in motor vehicles. With such a design, both a translatory and a tangential motion of the slider may be provided for actuating it. Advantageously, a body is used which expands under heat for this purpose. This body is also advantageously heated by the burner flame so that an automatic control of the slider position as a function of the operational condition of the burner is obtained.

Accordingly, it is an object of the invention to provide a method of burning liquid and/or gaseous fuel using a tubular combustion chamber and at least one baffle which has a central aperture therethrough which extends across the combustion chamber, comprising directing the fuel into the combustion chamber in a stream adjacent the baffle so as to cause it to flow through the aperture of the baffle, directing combustion air into the combustion chamber around and substantially parallel to the fuel stream so as to cause a portion of the combustion air to be directed against the baffle plate and to whirl backwardly and adjacent the aperture and to mix with the remaining portion passing parallel to the fuel flow direction to produce turbulence in this vicinity for the intermixing of the fuel and air which is ignited, and including directing a separate combustion air stream into the intermixed fuel and combustion air on the opposite side of the baffle downstream from the fuel introduction side so as to penetrate the intermixed gases and to facilitate the complete combustion of the fuel.

A further object of the invention is to provide a burner which includes spaced inner and outer walls defining a space around a tubular combustion chamber which has a baffle extending thereacross with an opening and which includes a means for directing fuel into the combustion chamber so as to flow through the opening along with combustion air which is introduced therewith and which partially flows against the baffle and causes a turbulence in the vicinity of the fuel and with further means for supplying additional combustion air to the space between the walls and to direct a portion of this combustion air substantially radially into the intermix of fuel and primary combustion air stream.

A further object of the invention is to provide a burner which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
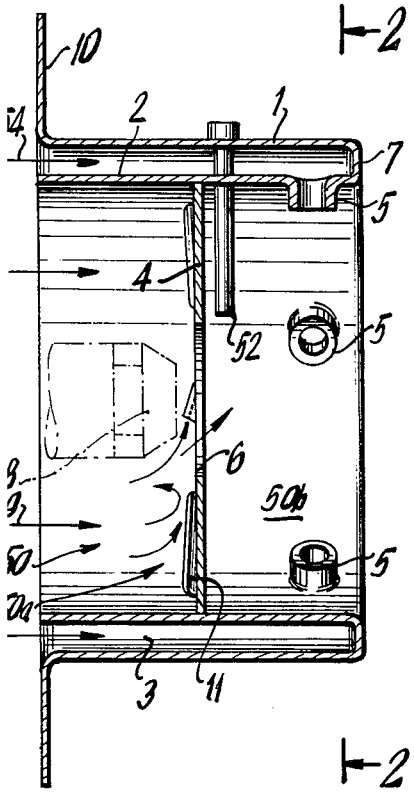
FIG. 1 is a transverse sectional view of a burner constructed in accordance with the invention.

Referring to the drawings in particular, the invention embodied therein in FIG. 1, comprises a burner which includes an outer housing or jacket 1, having an annular flange portion and an inner jacket 2 which is spaced radially inwardly from the outer jacket and defines an annular intermediate space 3 therebetween. Intermediate space 3 is closed at the downstream end by an end wall 7 which interconnects the outer jacket 1 and inner jacket 2. The interior of inner jacket 2 defines a combustion chamber 50 which is divided by a transverse baffle plate 4 into an upstream portion 50*a* and a downstream portion 50*b*. The baffle plate 4 includes a central opening 6. The intermediate space 3 which is provided for secondary combustion air has a plurality of radially inwardly directed nozzles or air sections 5 which are advantageously made of a length equal to from one-half to two times the inside diameter thereof. In the embodiment shown in FIG. 1, the nozzles are arranged in a common plane in the downstream portion 50*b* of the combustion chamber 50. A flange 10 provides means for mounting the housing so as to position a burner 8 so that it discharges fuel in a stream which starts in the upstream portion 50*a* and ends in the downstream portion 50*b*. An igniter 52 is advantageously provided in the downstream portion 50*b*.

In accordance with the method of the invention, combustion air which is supplied by a burner blower (not shown) flows into the interior of the outer jacket or into the annular space 3 in the direction of the arrow 54 and this secondary air exits through one or more of the nozzles 5 for admixing intimately with a fuel and air mixture which is produced by the discharge of the fuel from the fuel nozzle 8 through the opening 6 and by the inflow of primary combustion air in the direction of the arrow 9. The combustion air flowing in the direction of arrow 9 within upstream portion 50*a* strikes against baffle plate 4 and becomes dammed behind it so as to form a plurality of eddies and turbulent flow, as indicated generally by the arrows, which join with substantially parallel flow which is directed around the fuel nozzle 8 to the aperture 6. At the same time, the fuel which is fed through nozzle 8, along with the part of the primary air fed in the direction of arrow 9, enters through opening 6 of the baffle plate and is further mixed in a mixing zone at the entrance to the downstream portion 50*b*.

The fuel which is fed through the nozzle 8 may be an atomized liquid fuel or a gaseous fuel. The secondary air which flows into the downstream portion 50*b* from the nozzles or air outlet sockets 5 is directed in the form of concentrated local air jets which penetrate through and further intermixes with the intermixed primary air and fuel. Thereby, a particularly imtimate mixing of the fuel and combustion air is effected with a relatively small volume of secondary air which is discharged through the air outlet sockets 5 and an almost complete participation of the entire volume of the combustion air in the combustion is thus obtained. The igniter 52 causes ignition of the intimately mixed fuel and primary and secondary air mixture at a location close to the fuel nozzle 8. The air outlet sockets 5 in the embodiment of FIG. 1 have a circular cross-section, but the cross-section may be of a form other than circular.

Figure 2:
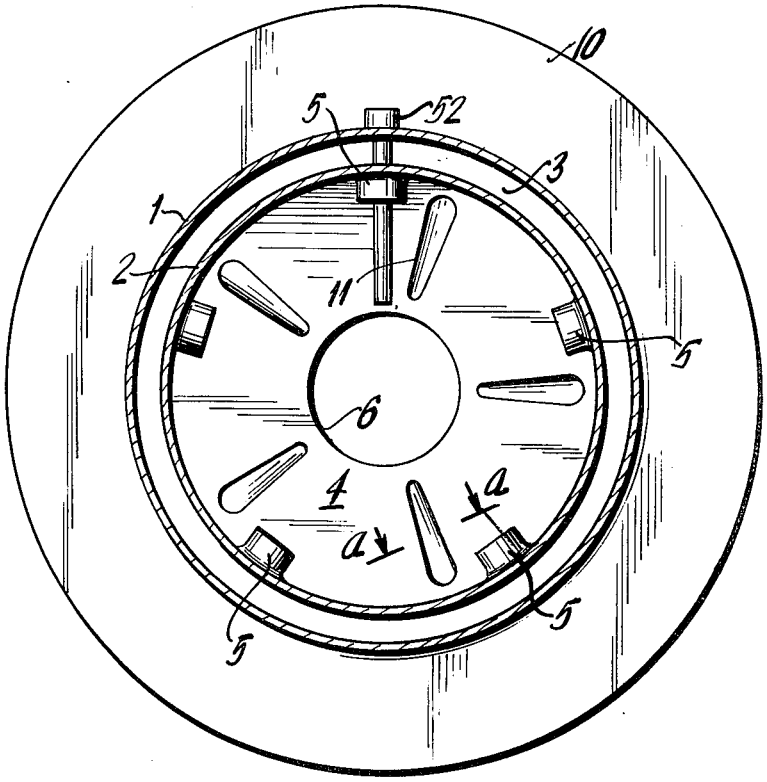
FIG. 2 is a section taken along the line 2—2 of FIG. 1.

As shown in FIG. 2, the baffle plate 4 may advantageously be provided with a plurality of radially extending apertures 11 which extend radially outwardly from the central aperture 6. Such a construction will result in a further improved mixing of the fuel and combustion air and will permit an adjustment to various rates of fuel flow by a corresponding selection of the angular spacing between the slots 11.

Figure 3:
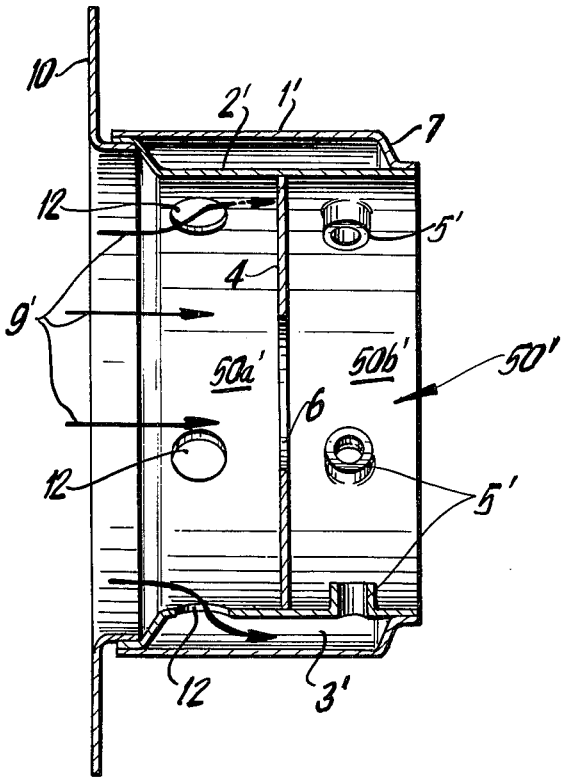
FIG. 3 is a view similar to FIG. 1 of another embodiment of the invention.

In the embodiment shown in FIG. 3, inner and outer walls 1' and 2' of a combustion chamber, generally designated 50' are constructed to be closed at each end and the inner wall 2' is provided with a plurality of circumferentially spaced openings 12 to permit inflow of the secondary air into the upstream portion 50*a'* of the combustion chamber 50'. One part of the combustion air indicated by the arrows 9' flows substantially parallel to the axis of the combustion chamber and a portion flows through apertures 12 into the intermediate space 3'. In this construction, this portion forms a secondary air supply which is directed outwardly through the nozzles 5' in the downstream portion 50*b'* of the combustion chamber 50'. This construction makes the mixing device insensitive to an obliquely oncoming flow. In addition, the turbulence produced at the apertures 12 increases the preheating of the combustion air which flows into the intermediate space 3'.

Figure 4:
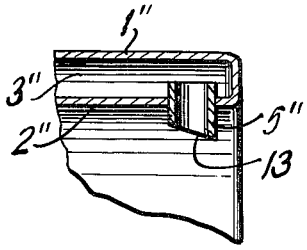
FIG. 4 is a partial sectional view of both the embodiments of FIGS. 1 and 2 showing another arrangement of secondary air flow nozzle.

In FIG. 4, a nozzle or air outlet socket 5'' is provided with an oblique or inclined outer rim around its discharge which is inclined relative to the radial plane thereof. Due to this inclination, which is a matter of free choice, the jets of the secondary air which issue from the air outlet sockets 5'' are correspondingly laterally deflected and an adjustment of the burner to the operational outer conditions is obtained in a particularly simple manner. Air outlet sockets 5'' project into the intermediate space 3'' and this construction facilitates the insertion of these nozzles into the inner wall or jacket 2''.

Figure 5:
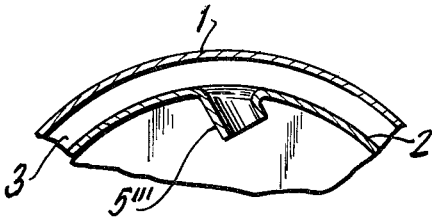
FIG. 5 is a view similar to FIG. 4 of still another embodiment of the invention.

In the arrangement shown in FIG. 5, at least a part of the air outlet sockets 5''' is positioned at an angle with respect to the radius of the inner jacket 2. In such a construction, the jets of secondary air issuing from air outlet sockets 5''' are directed in the same manner as with the freely selectable plane of inclination and this facilitates the adjustment of the burner.

Figure 6:
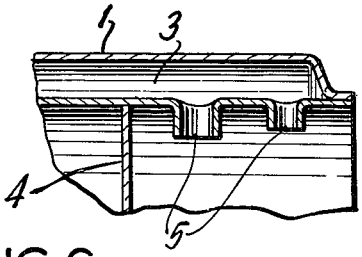
FIG. 6 is a view similar to FIG. 4 of still another embodiment of the invention.

In FIG. 6, air outlet nozzles 5 are arranged in a plurality of different planes which are spaced at distinct distances from the baffle plate 4 in the downstream direction. Preferably, the nozzles 5 which are located further downstream have a smaller cross-section than the ones further upstream. By separately dimensioning the cross-section of the nozzles 5, it is possible to provide a very effective control on the amount of secondary air intermixing along the length of the combustion chamber and this is very meaningful particularly with operation at a high rate of fuel flow.

Figure 7:
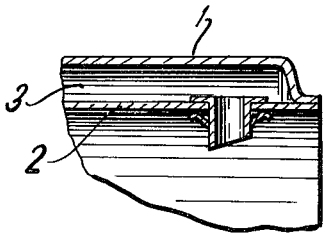
FIG. 7 is a view similar to FIG. 4 of another embodiment of the invention.

In FIG. 7, an air outlet socket, similar to the socket 5, includes a socket member 14 which is rotatably mounted in an opening of the inner wall 2 and for this purpose, it includes flanges 15 on each side of the mounting. The outlet rim 13 is inclined relative to the radial plane of the air outlet sockets 14. Flanges 15 advantageously comprise self-holding, resilient star springs which makes it possible to rotate these to a desired position before operating of the device in order to achieve the desired inflow direction of the secondary air into the combustion chamber.

Figure 8:
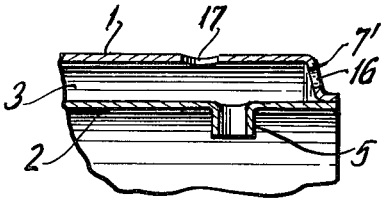
FIG. 8 is a view similar to FIG. 4 of a further embodiment of the invention.

In the embodiment shown in FIG. 8, the outer wall 1 is provided with openings 17 and a terminal wall 7' is also provided with an opening 16 which vents the space 3. Through these openings, a part of the combustion air flowing in the intermediate space 3 is discharged into the combustion chamber where it causes a post-combustion.

Figure 9:
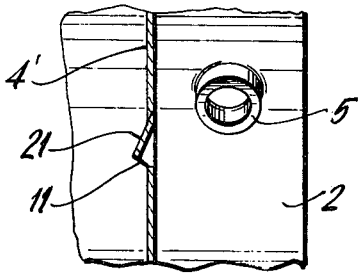
FIG. 9 is a sectional view taken along the line *a—a* of FIG. 2.

In the FIG. 9 embodiment, baffle plate 4' is provided with pockets 21 which are formed outwardly from the upstream surface thereof and shaped to effect a rotation of the primary combustion air about a longitudinal axis. In a similar manner, the baffle plate 4 may be fixed to the inner jacket 2 with a small circular gap surrounding the plate through which a part of the combustion air may pass into the mixing zone to obtain the further intermixing of the combustion air and gases.

Figure 10:
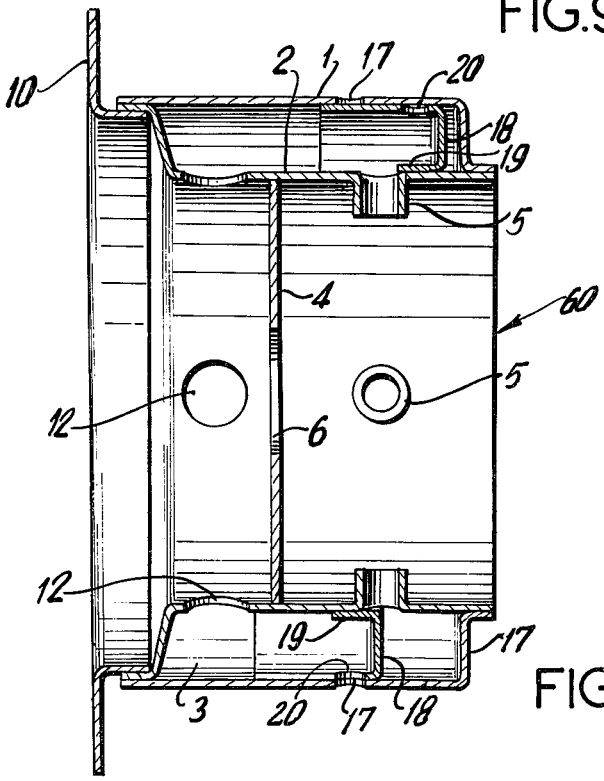
FIG. 10 is an axial sectional view similar to FIG. 1 of still another embodiment of the invention.

In the embodiment of FIG. 10, a burner, generally designated 60, has spaced inner and outer walls 1 and 2 with an annular slider 18 arranged therebetween which has a cylindrical extension 19 by means of which the exit of air from the air outlet sockets 5 is shut off in the position in which opening 20 provided in the outer extension of slider 18 communicates with openings 17 provided in outer jacket 1. In this position, as shown in FIG. 10, below the slider 18, a part of the combustion air flow in the intermediate space 3 and passes through openings 20 and 17 into the combustion chamber upstream portion 50*a* while the exit of the secondary air from the air outlet sockets 5 is interrupted. If, as shown in the upper part of FIG. 10, the slider 18 is axially displaced into its other position, its cylindrical extension 19 will clear the air outlet sockets 5 while the openings 17 will be closed.

Alternately, the slider 18 may be designed as a rotary slider and the air exit from the air outlet sockets 5 and openings 17 may be advantageously controlled by scalloped recesses provided in the cylindrical extensions of the slider 18, and which has not been shown.

The advantages obtained by the invention, are a great security against soot emission and a pulsation-free combustion during operation with boilers which have a very small combustion chamber and a high fuel gas resistance as well as for use in connection with long exhaust gas ducts. Since a substantially soot-free combustion is obtained even with an almost stoichiometric operation with excess air volumes of about 1.1, an operation with small cheap boilers which have a favorable boiler efficiency and a high firing efficiency is made possible. In addition, the advantages of a small environmental pollution and reduced power consumption of the blowers are obtained.

Further, with a small constructional expense of the burner equipped with the mixing device of the invention, the actual rate of fuel flow and the operational conditions of the boiler is made possible. The adjustment can be made directly at the installed burner.

While specific embodiments of the invention have been shown and described in detail to illustrate the application of the principles of the invention, it will be understood that the invention may be embodied otherwise without departing from such principles.

What is claimed is:

1. A burner construction comprising inner and outer tubular combustion walls which are radially spaced apart and have a space therebetween and with a combustion chamber being defined within the inner wall, said inner wall having at least one flow passage from the intermediate space between said inner and outer walls to said combustion chamber, a baffle plate extending across the combustion chamber and having a central flow aperture therethrough, fuel supply means for directing fuel centrally into said combustion chamber on one side of said baffle plate to direct the fuel through the opening of said baffle plate, first fuel air supply means for directing combustion air into said combustion chamber around said fuel supply means and against said baffle plate and through the aperture, and second combustion air supply means for directing air through the space between the walls in a concentrated stream radially inwardly into the combustion chamber downstream of the baffle plate, said second air supply means including a plurality of tubular socket members formed in said inner wall at spaced circumferential locations therearound and terminating at an inwardly directed nozzle, said baffle plate having a plurality of radially extending slots disposed around the aperture thereof equal to the number of said nozzles.

2. A burner construction according to claim 1, wherein the outer wall has a plurality of openings therein, a slider disposed in the space between said inner and outer walls and including means for covering the openings in said inner wall in at least one position of said slider, said slider being movable to a second position in which the openings are uncovered, said slider comprising a member subject to temperature change movable between said first and second positions in accordance with the temperature.

3. A burner construction, according to claim 1, wherein said second air supply means includes at least one nozzle extending from said intermediate space into the combustion chamber downstream of said baffle means and being of a length substantially one half to two times the diameter of said nozzle means.

4. A burner construction, according to claim 1, including ignition means in said combustion chamber located adjacent said fuel supply means.

5. A burner construction, according to claim 1, wherein said nozzles are rotatably mounted on said inner wall.

6. A burner construction, according to claim 1, including a plurality of apertures defined in said inner wall on the upstream side of said baffle plate permitting communication of the combustion air from said upstream side of said combustion chamber into said annular space around said combustion chamber between said inner and outer walls.

7. A burner construction, according to claim 1, wherein said nozzles are offset radially from said slots in said plate.

8. A burner construction, according to claim 1, wherein said inner and outer walls form closures at each end of the space between said walls with one of the ends having an opening therethrough.

* * * * *